US008127864B2

(12) United States Patent
Ibrahim et al.

(10) Patent No.: US 8,127,864 B2
(45) Date of Patent: Mar. 6, 2012

(54) HYDRO-PERCUSSIVE MECHANISMS FOR DRILLING SYSTEMS

(75) Inventors: George Ibrahim, Mississauga (CA); Christopher L. Drenth, Draper, UT (US)

(73) Assignee: Longyear TM, Inc., South Jordan, UT (US)

( * ) Notice: Subject to any disclaimer, the term of this patent is extended or adjusted under 35 U.S.C. 154(b) by 270 days.

(21) Appl. No.: 12/624,296

(22) Filed: Nov. 23, 2009

(65) Prior Publication Data

US 2010/0126772 A1 May 27, 2010

Related U.S. Application Data

(60) Provisional application No. 61/118,210, filed on Nov. 26, 2008.

(51) Int. Cl.
*E21B 4/14* (2006.01)

(52) U.S. Cl. ..... 175/57; 175/58; 175/297; 175/405

(58) Field of Classification Search ..... 175/57, 175/58, 297, 296, 405; 173/138, 136
See application file for complete search history.

(56) References Cited

U.S. PATENT DOCUMENTS

| | | | | |
|---|---|---|---|---|
| 2,005,989 | A * | 6/1935 | Burt | 175/255 |
| 3,311,177 | A * | 3/1967 | Collier et al. | 173/133 |
| 3,583,501 | A * | 6/1971 | Aalund | 175/96 |
| 3,768,576 | A * | 10/1973 | Martini | 173/73 |
| 3,970,335 | A * | 7/1976 | Curington et al. | 285/123.3 |
| 4,002,213 | A * | 1/1977 | Sweeney | 175/58 |
| 4,530,407 | A * | 7/1985 | Rear | 173/17 |
| 2005/0000735 | A1 * | 1/2005 | Darnell | 175/296 |

* cited by examiner

*Primary Examiner* — Nicole Coy
(74) *Attorney, Agent, or Firm* — Workman Nydegger

(57) ABSTRACT

A down-the-hole assembly includes a housing assembly having a head end and a bit end. The housing assembly further includes an inlet joint having an inlet channel defined therein, a sealing portion positioned toward the bit end relative to the inlet joint, and an outlet portion positioned toward the bit end relative to the sealing portion. A hammer assembly including a piston has a piston channel defined therein that includes an inlet in fluid communication with the inlet channel and an outlet in fluid communication with the housing assembly.

25 Claims, 6 Drawing Sheets

HYDRO-PERCUSSIVE MECHANISMS FOR DRILLING SYSTEMS

RELATED APPLICATIONS

This application claims the benefit of U.S. Provisional Patent Application Ser. No. 61/118,210 filed Nov. 26, 2008, the disclosure of which is hereby incorporated by reference in its entirety.

BACKGROUND OF THE INVENTION

1. The Field of the Invention

The present invention relates to down-the-hole tools and to hydro-percussive mechanisms for down-the-hole applications.

2. The Relevant Technology

Core drilling allows samples of subterranean materials from various depths to be obtained for many purposes. For example, drilling a core sample and testing the retrieved core helps determine what materials are present or are likely to be present in a given formation. For instance, a retrieved core sample can indicate the presence of petroleum, precious metals, and other desirable materials. In some cases, core samples can be used to determine the geological timeline of materials and events. Accordingly, core samples can be used to determine the desirability of further exploration in a given area.

Although there are several ways to collect core samples, core barrel systems are often used for core sample retrieval. Core barrel systems include an outer tube with a coring drill bit secured to one end. The opposite end of the outer tube is often attached to a drill string that extends to a drill head that is often located above the surface of the earth. The core barrel systems also often include an inner tube located within the outer tube. As the drill bit cuts formations in the earth, the inner tube can be filled with a core sample. Once a desired amount of a core sample has been cut, the inner tube and core sample can be brought up through the drill string and retrieved at the surface.

When cutting through ultra-hard formations, a constant force axial force, or thrust force, is applied to the bit as the bit is rotated resulting in shearing forces between the bit and the rock formation. The shearing forces break bits of material from the ultra-hard formation as the bit is rotated. While such a process can cut a core sample from ultra-hard formations, such a process may be relatively slow.

The subject matter claimed herein is not limited to embodiments that solve any disadvantages or that operate only in environments such as those described above. Rather, this background is only provided to illustrate one exemplary technology area where some embodiments described herein may be practiced

BRIEF SUMMARY OF THE INVENTION

A down-the-hole assembly includes a housing assembly having a head end and a bit end. The housing assembly further includes an inlet joint having an inlet channel defined therein, a sealing portion positioned toward the bit end relative to the inlet joint, and an outlet portion positioned toward the bit end relative to the sealing portion. A hammer assembly including a piston has a piston channel defined therein that includes an inlet in fluid communication with the inlet channel and an outlet in fluid communication with the housing assembly. The assembly further includes an anvil assembly and a biasing member positioned at least partially between the hammer assembly and the anvil assembly to exert a biasing force between the hammer assembly and the anvil assembly to urge the hammer assembly toward the head end to position the outlet in the piston in communication with the sealing portion of the housing assembly and wherein the translation of the hammer assembly toward the anvil assembly moves the outlet in the piston into communication with the outlet portion of the housing assembly.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

Figure 1:
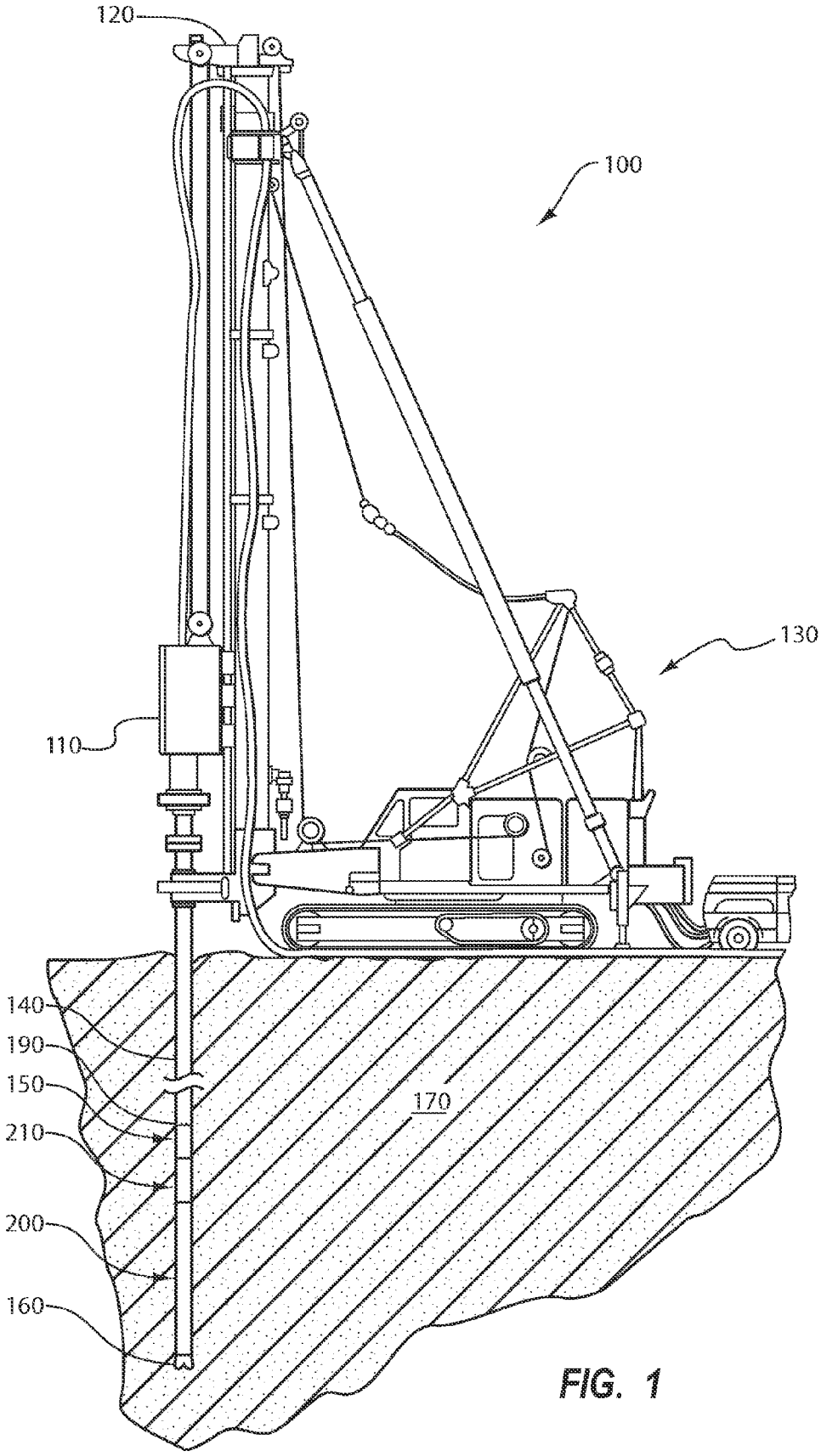
FIG. 1 illustrates a drilling system with a hydro-percussive mechanism according to one example.

Together with the following description, the Figs. demonstrate non-limiting features of exemplary devices and methods. The thickness and configuration of components can be exaggerated in the Figures for clarity. The same reference numerals in different drawings represent similar, though necessarily identical, elements.

DETAILED DESCRIPTION OF THE PREFERRED EMBODIMENTS

Devices, systems and methods are provided herein for retrieving a core-sample using a combination of locally applied percussive or impact forces and shear or rotational forces to a drill bit. In at least one example, a hydro-percussive mechanism may be positioned down-the-hole so as to be in relative proximity with a core barrel assembly. A hydro-percussive mechanism can include an outer housing assembly that houses an inlet, a hammer assembly, a biasing member, and an anvil assembly. The biasing member can be positioned between the hammer assembly and the anvil assembly so as to apply a biasing force to at least the hammer assembly to urge the hammer assembly toward the inlet.

Pressurized fluid is directed through the inlet to be incident on the hammer assembly. The hammer assembly includes outlets defined therein that are initially closed engagement with a sealing portion of the outer housing assembly. While the outlets are closed, pressure from the incident fluid builds until the pressure exerts a pressure force that overcomes the biasing force. The pressure force then causes the hammer assembly to translate within the outer housing. Inertia associated with this motion carries the hammer assembly into contact with the anvil assembly to transmit a percussive force to the anvil assembly. The anvil assembly in turn can be coupled to a downstream component, such as a core barrel assembly, to transmit the percussive force to the core barrel assembly.

The outer housing assembly also includes an outlet portion that when in proximity to the outlets allows fluid to flow through the outlets. In at least one example, this portion of the outer housing assembly is positioned such that as inertia and/or pressure forces carry the hammer assembly toward the anvil assembly, the outlets in the hammer assembly move into communication with the outlet portion, which allows the fluid flows through the outlets and into the outlet portion. As the fluid moves through the outlets, the pressure on the hammer assembly is relieved and the biasing member urges the hammer assembly toward the inlets such that the outlets again engage the sealing portions of the outer housing. The process then begins again, thereby providing a cyclical percussive force.

As will be discussed in more detail below, the interaction of the outlets in the hammer assembly with the inlet and outlet portions on the outer housing assembly form an integrated valve configuration. In particular, movement of the hammer assembly within the outer tube assembly moves the outlets between sealing engagement and non-sealing engagement with the outer tube assembly, thereby providing integrated, cyclical valving between the hammer assembly and the rest of the hydro-percussive mechanism. Such a configuration may provide for robust and reliable cyclical valving between the hammer assembly and the rest of the hydro-percussive mechanism as valving is accomplished by movement of the entire hammer assembly rather than separate and/or external moving parts.

For ease of reference, liquids will be described as the motive fluids for performing the percussive forces described below. Further, a hydraulic system will be described. Though one such configuration will be described, it will be appreciated that other fluids and/or liquids may be used as the motive fluids. Additionally, while hydro-percussive mechanism are described below with reference to core-barrel assemblies, it will be appreciated that hydro-percussive mechanism can be coupled to or be part of any number of down-the-hole systems. Further, hydro-percussive mechanisms may be coupled to a drill string at any desired location. Accordingly, the following description supplies specific details in order to provide a thorough understanding. Nevertheless, the skilled artisan would understand that assemblies and associated system can be implemented and used without employing these specific details.

FIG. 1 illustrates a drilling system 100 that includes a drill head 110. The drill head 110 can be coupled to a mast 120 that in turn is coupled to a drill rig 130. The drill rig 130 is configured to move the drilling system 100 to a desired location. The mast in turn is configured to support and orient the drill head 110. The drill head 110 is configured to have a drill rod 140 coupled thereto. The drill rod 140 can in turn be coupled to additional drill rods to form a drill string 150. In turn, the drill string 150 can be coupled to a drill bit 160 configured to interface with the material to be drilled, such as a formation 170.

In at least one example, the drill head 110 illustrated in FIG. 1 is configured rotate the drill string 150 during a drilling process. In particular, the rotational rate of the drill string can be varied as desired during the drilling process. Further, the drill head 110 can be configured to translate relative to the mast 120 to apply an axial force to the drill head 110 to urge the drill bit 160 into the formation during a drilling process. The drilling system 100 also includes a down-the-hole assembly 200, such as a core-barrel assembly. A hydro-percussive mechanism 210 can be coupled to or be part of the down-the-hole assembly 200. In at least one example, the hydro-percussive mechanism 210 can be located down the borehole between the drill string 150 and the drill bit 160.

The hydro-percussive mechanism 210 provides a cyclical percussive force that is transmitted to the drill bit 160. For example, the hydro-percussive mechanism 210 can be configured to provide a cyclical percussive force as pressure builds and is relieved through the movement of a hammer assembly relative to an outer housing, as will be described in more detail below.

While one configuration is illustrated, it will be appreciated that the hydro-percussive mechanism 210 can be located at any position along the drill string 150. Further, while one type of motive power for driving the hydro-percussive mechanism 210 will be described, it will be appreciated that other types of motive power can be provided in any suitable manner, such as by hoses or other devices that are coupled to the hydro-percussive mechanism 210. In the illustrated example, the down-the-hole tool 200 can be submerged in liquid, represented by waterline 190. In the illustrate example, the rig 130, the drill head 110, and/or other associated equipment can include a pressure generator that can pressurize the interior of the drill string 150 to force pressurized liquid into the hydro-percussive mechanism 210. The pressurized liquid then acts as the motive force to drive the hydro-percussive mechanism 210 to locally apply a cyclical percussive force to the drill bit 160. One exemplary core-barrel assembly will now be discussed in more detail.

Figure 2A:
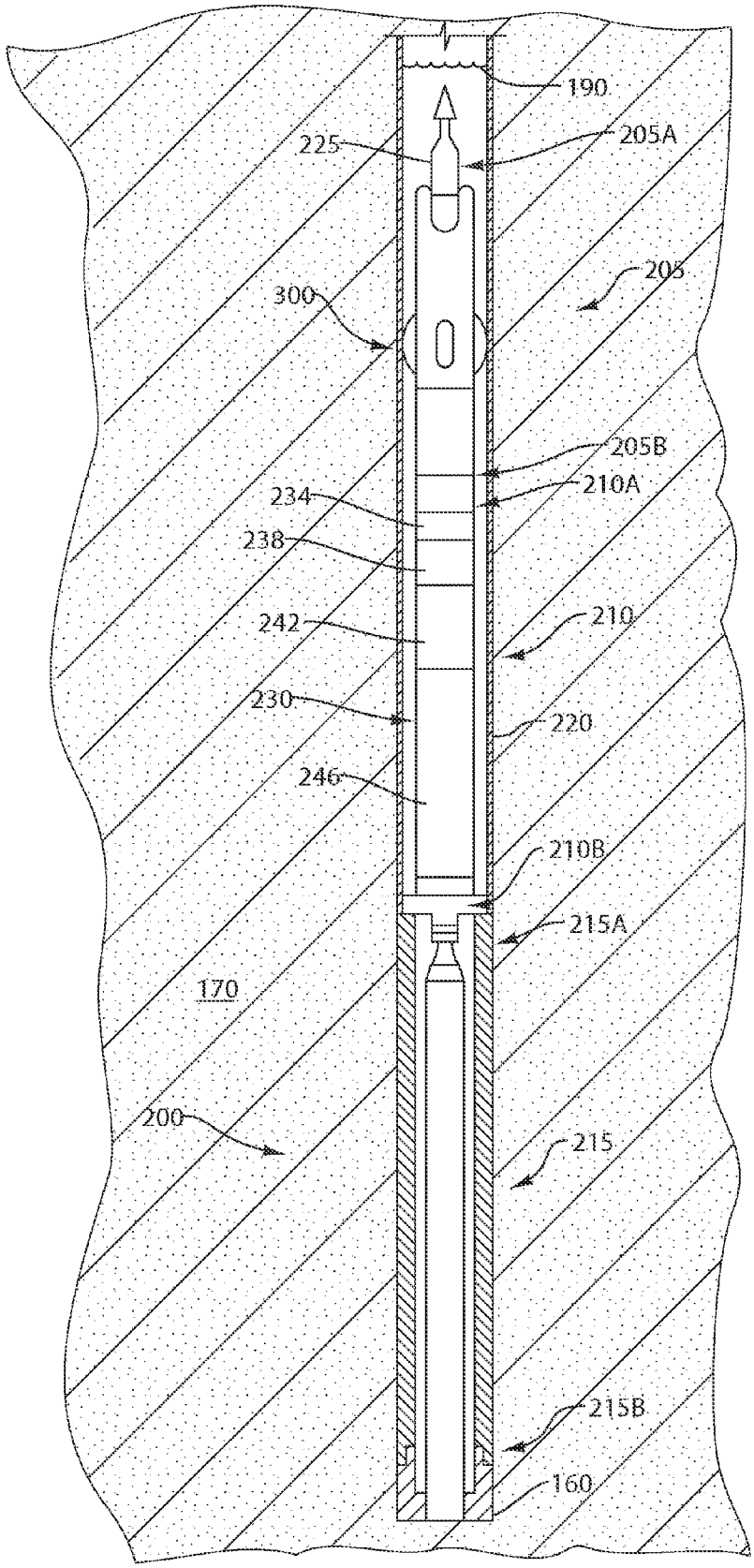
FIG. 2A illustrate a hydro-percussive mechanism located down-the-hole relative to an outer tube according to one example.
Figure 2B:
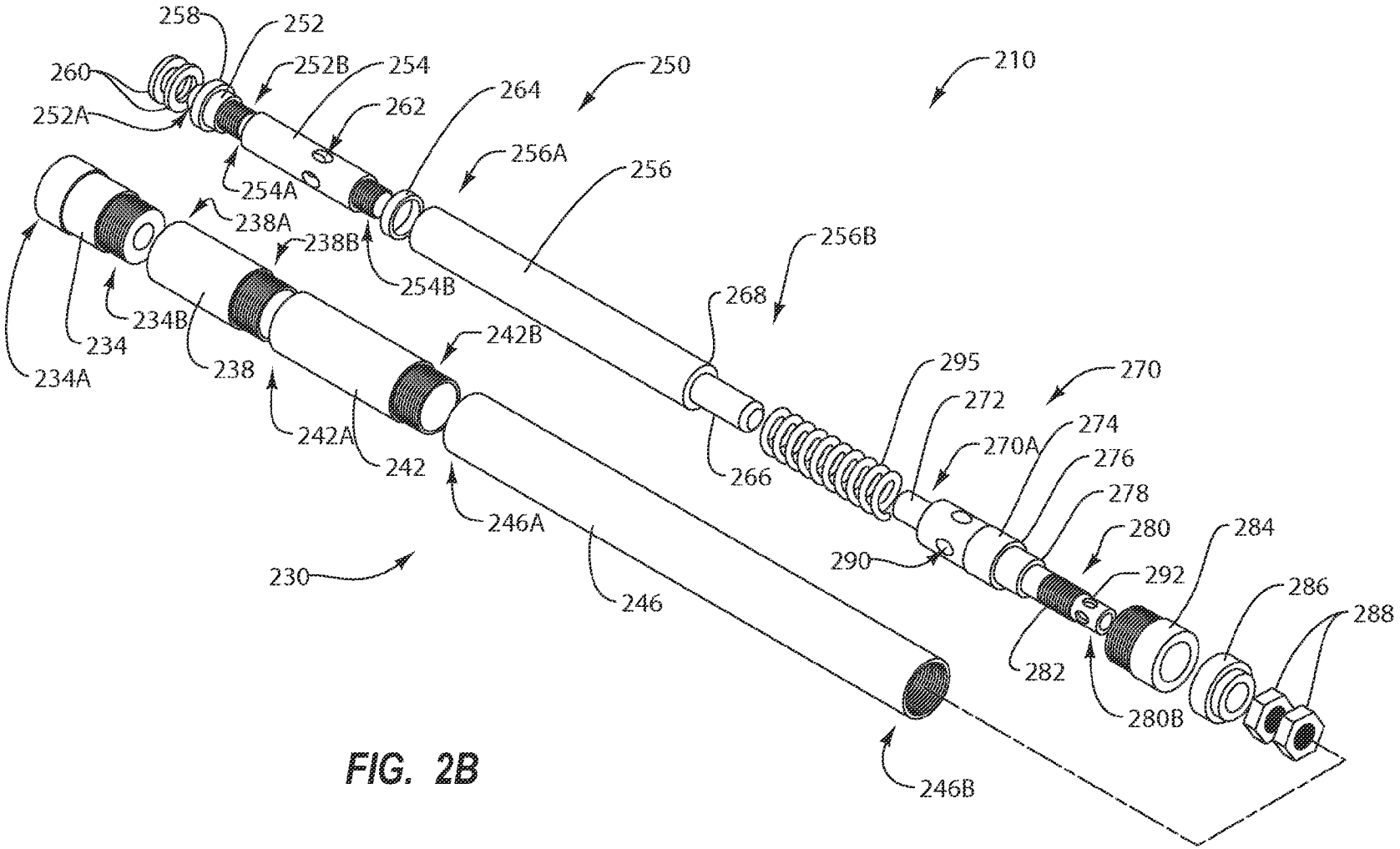
FIG. 2B illustrates an exploded view of the hydro-percussive system illustrated in FIG. 2A.

FIGS. 2A-2B illustrates a core-barrel assembly 200 according to one example. In particular, FIG. 2A illustrates the core-barrel assembly 200 positioned within a formation 170 while FIG. 2A illustrates an isolated, exploded view of the core-barrel assembly 200. As illustrated in FIG. 2A, the core-barrel assembly 200 includes a head assembly 205, a hydro-percussive mechanism 210, and a core-lifter assembly 215. In at least one example, the hydro-percussive mechanism 210 can perform similar function as hydro-percussive mechanism 190 described above with reference to FIG. 1

As illustrated in FIGS. 2A-2B, the core-barrel assembly 200 can be a wire-line type core-barrel assembly. Accordingly, the head assembly 205, the hydro-percussive mechanism 210, and the core-lifter assembly 215 can be located at least partially within an outer tube 220. In a similar manner as discussed above, when the core barrel assembly 200 is in position relative to the formation 170, hydro-percussive mechanism 210 can be submerged in water, as illustrated by the water line 190. The outer tube 220 can then be pressurized to drive pressurized fluid into the hydro-percussive mechanism 210. The drill bit 160 can in turn be coupled secured to the outer tube 220 such that as the outer tube 220 rotates the drill bit 160 also rotates.

As illustrated in FIG. 2A, the head assembly 205 includes a head end 205A and a bit end 205B, the hydro-percussive mechanism 210 includes a head end 210A and a bit end 210B, and the core-lifter assembly 215 includes a head end 215A and a bit end 215B. In the illustrated example, the core-barrel assembly 200 is wire-line type core-barrel assembly. Accordingly, the head end 205A of the head assembly 205 can include a spear-point assembly 225 that is configured to engage an overshot. The head assembly 205 can further include a latch assembly 300, which will be described in more detail beginning with FIG. 3A.

By way of introduction, as illustrated in FIG. 2A the latch assembly 300 is configured to be deployed to thereby secure the core-barrel assembly 200 to the outer tube 220 once the core barrel assembly 200 is in position relative to the outer tube 220 and the formation 170. Such a configuration causes the core-barrel assembly 200 to rotate with the outer tube 220. As the outer tube 220 rotates, a combination of axial or thrust forces from the drill head 110 and percussive forces from the hydro-percussive mechanism 210 force the drill bit 160 into the formation 170.

In particular, the hydro-percussive mechanism 210 applies a percussive force to at least the core-lifter assembly 215 in at least one direction to thereby increase localized forces between the drill bit 160 and the formation. As previously introduced, the drill head 110 (FIG. 1) is configured to apply an axial or thrust force to the drill string 150 that is transmitted to the drill bit 160. The thrust force provides a penetrating force normal to the direction of rotation of the drill bit 160 that breaks the bond holding the rock particles together.

The hydro-percussive mechanism 210 provides percussive forces in addition to the thrust forces. These percussive forces impart compression loads at the drill bit 160 that enhance the penetration of the drill bit 160 under increased load resulting in enhanced rock breakage of the formation 170 at the drill bit 160. The then broken rock can then be dragged away by rotation of the drill bit 160. Breaking the formation 170 in such a manner can result in a reduced load on the drill bit 160 as it rotates, thereby allowing the drill bit 160 to drag through a lesser amount of material. As previously introduced, the hydro-percussive mechanism 210 can be powered by any motive force desired. As the drill bit 160 thus cuts through the formation, the drill bit 160 forces a core-sample into the core-lifter assembly 215.

FIG. 2B illustrates an exploded view of the hydro-percussive mechanism 210. As illustrated in FIG. 2B, the hydro-percussive mechanism 210 generally includes an outer housing assembly 230, a hammer assembly 250, an anvil assembly 270, and a biasing member 295. The components and grouping of the components described below are provided for ease of illustration only. It will be appreciated that one or more of the components can be integrated into fewer components or divided into more components. Further, components described with reference to one assembly may be combined and/or integrated with other assemblies.

As illustrated in FIG. 2B, the outer housing assembly 230 includes an inlet joint 234, a top locking joint 238, a piston sleeve joint 242, and a main housing 246. In the illustrated example, the head ends 234A-246A of the components of the outer housing assembly 230 can have a box-end configuration while the bit ends 234B-246B can have a pin-end configuration. Accordingly, the bit end 234B of the inlet joint 234 can be coupled to the head end 238A of the top locking joint 238. The bit end 238B of the top locking joint 238 can be similarly coupled to the head end 242A of the piston sleeve joint 242 and the bit end 242B of the piston sleeve joint 242 can be coupled to the head end 246A of the main housing 246. As previously introduced, the outer housing assembly 230 is configured to house at least a portion of the hammer assembly 250 and the anvil assembly 270. The grouping of the components of the hammer assembly 250 and the anvil assembly 270 will first be discussed, followed by a discussion of the location of these assemblies within the outer housing assembly 230.

As illustrated in FIG. 2B, the hammer assembly 250 generally includes a piston 252, a piston rod 254, and a hammer body 256. As illustrated in FIG. 2B, the piston 252 has a flange 258 between a head end 252A and a bit end 252B. The head end 252A can be configured to receive and support one or more seals, such as rubber seal 260 while the bit end 252B is configured to be coupled to the head end 254A of the piston rod 254.

The piston rod 254 includes one or more hammer outlets 262 defined therein between the head end 254A and the bit end 254B. The bit end 254B is configured to be coupled to the head end 256A of the hammer body 256. In at least one example, a bushing, such as a rubber bushing 264, is positioned between the piston rod 254 and the hammer body 256. A bit end 256B of the hammer body 256 is coupled to a hammer anvil 266. The hammer anvil 266 in the example shown has a relatively narrow cross section compared to the hammer body 256 such that the hammer body 256 ends in a shoulder 268. In at least one example, the hammer anvil 266 is configured to receive a portion of the biasing member 295 while the shoulder 268 is configured to provide a surface to which the biasing member 295 is able to transmit a biasing force to the hammer assembly 250.

The anvil assembly 270 can also be configured to support the biasing member 295 in such a manner to provide a base from which the biasing member 295 can exert a biasing force on the hammer assembly 250. In the illustrated example, the anvil assembly 270 includes a lower anvil 272 that is operatively associated with an anvil body 274. The anvil body 274 includes one or more shoulders 276, 278. The anvil body 274 further includes an outlet neck 280 with a threaded portion 282. The outlet neck 280 is configured to pass through an anvil locking joint 284 and a receiving ring 286 such that shoulder 276 is seated relative to the anvil locking joint 284 and shoulder 278 is seated relative to the receiving ring 286. The anvil assembly 270 can then be secured in an assembled state by threading locking nuts 288 onto the threaded portion 282. A liquid pathway is formed between anvil inlets 290 near a head end 270A of the anvil body 270 and anvil outlets 292 formed in the outlet neck 280. The liquid pathway in the anvil body 280 provides for an outlet for spent liquid after the liquid has exerted pressure on the hammer assembly 250. The assembled hydro-percussive mechanism 210 will now be discussed in combination with the core-barrel assembly 200. Liquid pathways will then be described with the hammer assembly 250 at various positions within the hydro-percussive mechanism 210.

Figure 3A:
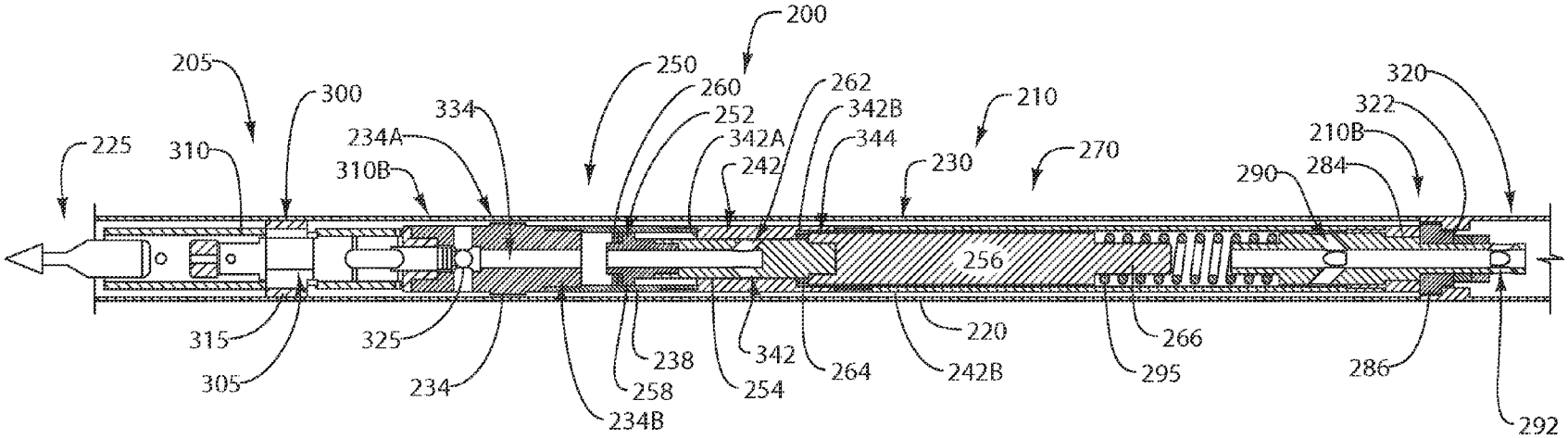
FIG. 3A illustrates a hydro-percussive mechanism in a hanging state according to one example.

FIG. 3A illustrates a partial, assembled cross-sectional view of the core barrel assembly 200 in which the hydro-percussive mechanism 210 is in a hanging state. FIG. 3A also illustrates the relative position of the hammer assembly 250 and the anvil assembly 270 within the housing assembly 230.

As illustrated in FIG. 3A, the head assembly 205 generally includes the spear point assembly 225 and the latch assembly 300. The spear point assembly 225 can be configured to interact with an overshot assembly (not shown) to be raised and lowered into position. The spear point assembly 225 is also operatively associated with a latch linkage assembly 305, which can be part of the latch assembly 300. The latch linkage assembly 305 can be supported by a latch housing 310. The latch linkage assembly 305 can be further coupled to latches 315 in such a manner that the latches 315 are deployed when the spear point assembly 225 is released from the overshot assembly to lock the head assembly 205 into place relative the outer tube 220.

In the hanging state, the bit end 210B of the hydro-percussive mechanism 210 is seated relative to a lower barrel portion 320 of the outer tube 220. In particular, the lower barrel portion 320 has a shoulder 322 formed therein that is configured to receive and support the receiving ring 286. This engagement between the lower barrel portion 320 and the receiving ring 286 causes the percussive forces generated by the hydro-percussive device 210 to be transmitted to the lower barrel portion 320. The lower barrel portion 320 in turn is coupled to the bit 160 (FIG. 2A).

A bit end 310B of the latch housing 310 is configured to be coupled to the head end 234A of the inlet joint 234, such as by way of a swivel joint 325. In other examples, the latch housing 310 is coupled to the inlet joint 234 in other manners, such as directly or by way of a different intermediate component, such as a non-swiveling joint. In the example illustrated, a gap is provided between the swivel joint 325 and a head end 234A of the inlet joint 234.

The inlet joint 234 has an inlet channel 334 defined therein. As illustrated in FIG. 3A, the piston 252 can be located in the top locking joint 238. The outer diameter of the flange 258 can correspond relatively closely to the inner diameter of the top locking joint 238 to minimize the flow of liquid around the flange 258. The rubber seals 260 can also further reduce the flow of liquid around the flange 258, thus providing a working seal between the piston 252 and the top locking joint 238.

As previously introduced, the top locking joint 238 is coupled to the piston sleeve joint 242. The piston sleeve joint 242 includes a sealing portion 342 and an outlet portion 344. An inner diameter of the sealing portion 342 can be smaller than an inner diameter of the outlet portion 344. Further, the sealing portion 342 can end at shoulders 342A, 342B. It will be appreciated that the sealing portion 342 can transition between the bit end 242B and/or the outlet portion 344 in any manner, such as a smooth transition, a rounded transition, or other type of transition.

The rubber bushing 264 can be positioned on the piston rod 254 near the head end 256A of the hammer body 256. While in first position illustrated, the rubber bushing 264 can contact shoulder 342B. This contact between the rubber bushing 264 and the shoulder 342B can provide a seal between the piston sleeve joint 242 and the piston rod 254 while the hydro-percussive mechanism 210 is in the first position. Providing a seal between the piston sleeve joint 242 and the piston rod 254 can help ensure liquid entering the piston rod 254 exerts pressure thereon.

Figure 3B:
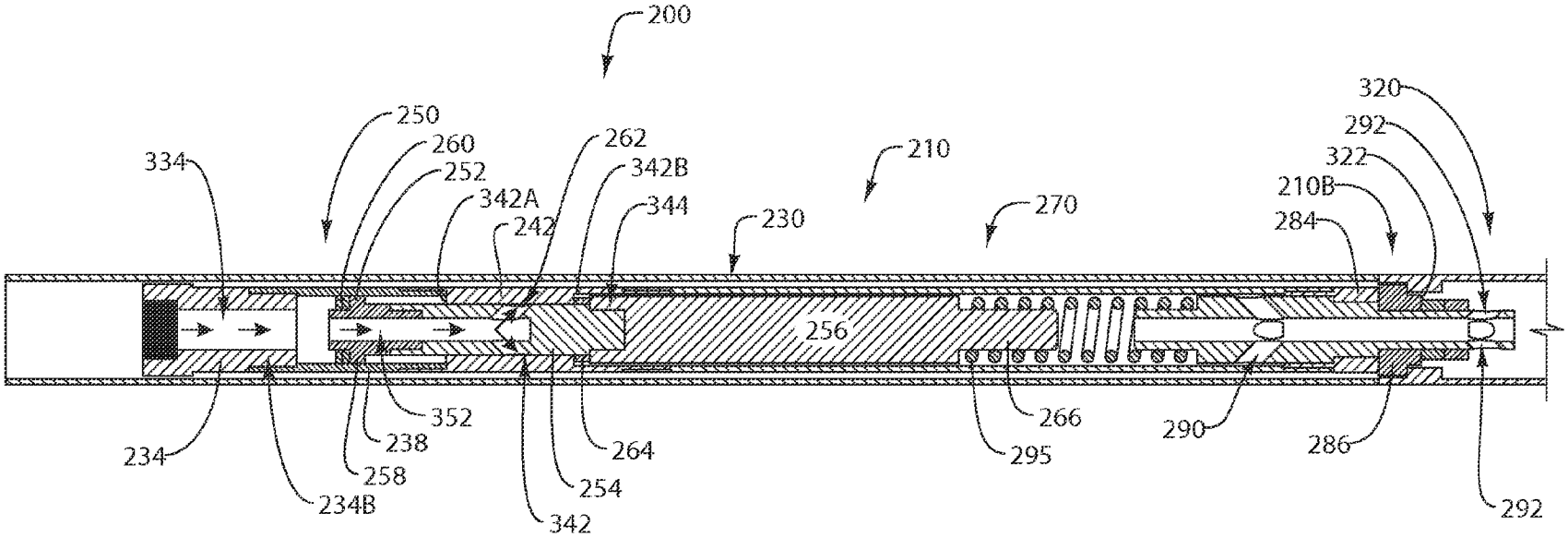
FIG. 3B illustrates the hydro-percussive mechanism shown in FIG. 3A in a building stage according to one example.

FIG. 3B illustrates the hydro-percussive mechanism 210 in a building stage. In the building stage, a liquid flow, indicated by the arrows, is directed through the inlet channel 334 to the piston 252. A piston channel 352 passes through the piston 252 and piston rod 254. The piston channel 352 is in communication with the outlets 262. Accordingly, liquid flows from the inlet channel 334, through the piston channel 352 and to the outlets 262. As illustrated in FIG. 3B, during the building stage the outlets 262 are blocked by the sealing portion 342 of the piston sleeve joint 242.

The blocking of the liquid pathway causes pressure to build on the piston rod 254. The pressure results in a driving force. If the pressure is sufficiently great a driving force will be exerted on the piston rod 254 that is sufficient to overcome the biasing force exerted on the hammer assembly 250 by the biasing member 295 to move the hydro-percussive mechanism 210 to a percussive stage.

Figure 3C:
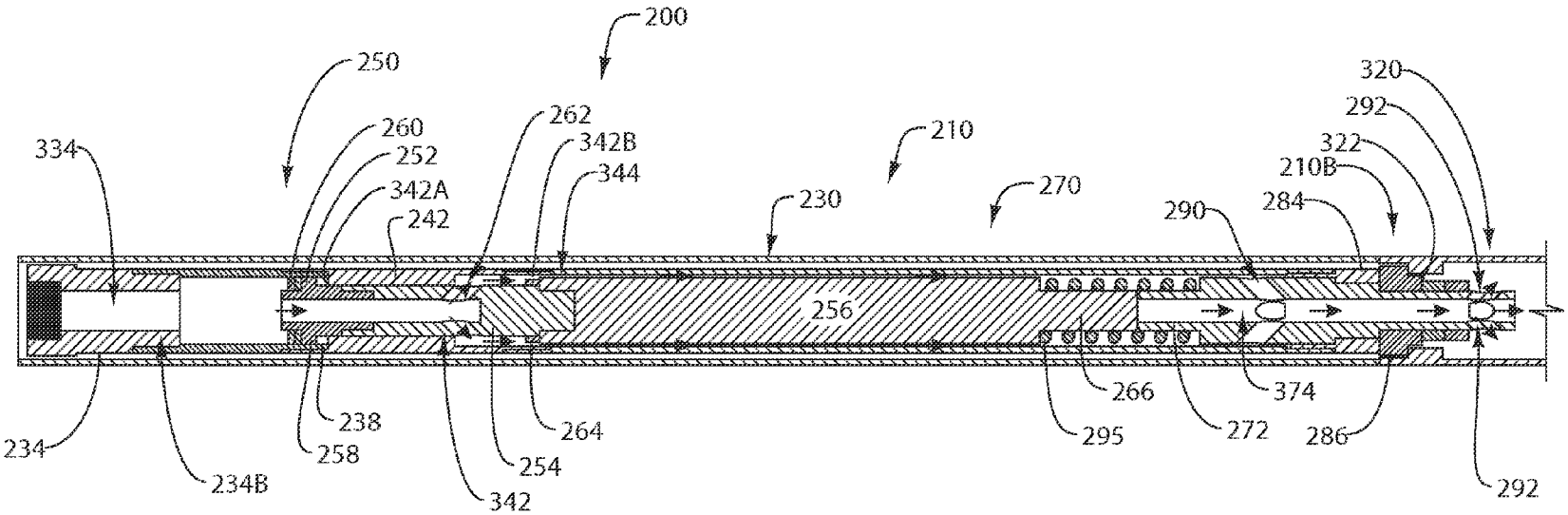
FIG. 3C illustrates the hydro-percussive mechanism of FIGS. 3A and 3B in a percussive stage according to one example.

FIG. 3C illustrates the hydro-percussive mechanism 210 in a percussive stage. In the percussive stage, the force generated by the pressure above causes the hammer assembly 250 to translate axially. Inertia associated with the axial translation carries the hammer anvil 266 to hit the lower anvil 272, resulting in a percussive force on the anvil assembly 270. As previously introduced, the receiving ring 286 of the anvil assembly 270 is seated on the lower barrel assembly 320. As such, the percussive force is transmitted from the anvil assembly 270 to the lower barrel assembly 320.

As the hammer assembly 250 translates axially as described above, the hammer outlets 262 move from proximity and engagement with the sealing portions 342 of the piston sleeve joint 242 into proximity with the outlet portion 344 of the piston sleeve joint 242. While the outlets 262 are in proximity with the outlet portion 344, the hammer outlets 262 are uncovered, thereby providing a liquid pathway from the hammer outlets 262 and around the hammer body 256. The liquid then travels into one or more of the anvil body inlets 290. The anvil body inlets 290 are in communication with an anvil channel 374. The anvil channel 374 is in communication with the anvil outlets 292.

Accordingly, while the hammer assembly 250 is in a percussive stage, a liquid pathway extends from the inlet channel 334, through the hammer outlets 262, around the hammer body 256, through the anvil inlets 290, through the anvil channel 374, and out the anvil outlets 292. As the liquid flows along the pathway, the pressure on the piston 252 and piston rods 254 is relieved, resulting in decreased pressure forces. With the pressure forces decreased, the force exerted by the biasing member 295 urges the hammer assembly 250 back toward the inlet joint 234 to thereby restore the hydro-percussive mechanism 210 to the building stage illustrated in FIG. 3B.

Thereafter, the pressure forces will again build and the process will repeat itself while liquid is forced through the inlet joint 234 resulting in cyclical percussive forces due to the oscillating impact of the hammer anvil 266 on the lower anvil 272. The forces are transmitted from the anvil assembly 270 to the lower barrel assembly 320 as described above. The process then repeats as pressurized fluid is directed to the hydro-percussive mechanism 210 to thereby generate cyclical percussive forces. Such a configuration may provide for robust and reliable cyclical valving between the hammer assembly and the rest of the hydro-percussive mechanism as valving is accomplished by movement of the entire hammer assembly rather than separate and/or external moving parts.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A down-the-hole assembly, comprising:

a housing assembly having a head end and a bit end; the housing assembly further comprising:
an inlet joint having an inlet channel defined therein;
a sealing portion; and
an outlet portion;

a hammer assembly having a piston and a hammer, the piston having a piston channel defined therein, the piston channel having an inlet in fluid communication with the inlet channel and an outlet in fluid communication with the housing assembly; and an anvil assembly including an anvil and an anvil channel extending through the anvil;

wherein translation of the hammer assembly toward the anvil assembly moves the outlet in the piston into communication with the outlet portion of the housing assembly such that fluid can flow from the inlet joint to the anvil channel, through the anvil channel, and below the anvil.

2. The down-the-hole assembly of claim 1, wherein the sealing portion is positioned toward the bit end relative to the inlet joint.

3. The down-the-hole assembly of claim 2, wherein the outlet portion is positioned toward the bit end relative to the sealing portion.

4. The down-the-hole assembly of claim 1, further comprising a biasing member positioned at least partially between the hammer assembly and the anvil assembly to exert a biasing force between the hammer assembly and the anvil assembly to urge the hammer assembly toward the head end to position the outlet in the piston is in communication with the sealing portion of the housing assembly.

5. The assembly of claim 1, wherein the inlet in the piston is positioned along a central axis and wherein the outlets in the piston are positioned around a periphery of the piston.

6. The assembly of claim 1, wherein the hammer assembly is configured to move from a hanging state in which flow through the piston is limited by engagement between the outlet in the piston and sealing portion of the housing assembly to apply a percussive force to the anvil assembly in response to a flow of fluid to the piston.

7. The assembly of claim 6, wherein the hammer assembly is configured to move toward the hanging state in response to the biasing force by allowing fluid to pass from the outlets while the outlets in the piston are in communication with the outlet portions of the housing assembly.

8. The assembly of claim 1, wherein at least a portion of the anvil channel extends axially through the anvil.

9. The assembly of claim 8, wherein anvil channel includes at least one inlet near a head end of the anvil assembly and an outlet near a bit end of the anvil assembly.

10. The assembly of claim 1, further comprising a core barrel assembly coupled to a bit end of the hydro-percussive mechanism.

11. The assembly of claim 10, wherein the core barrel includes an inner tube positioned within an outer tube.

12. The assembly of claim 11, wherein the inner tube is coupled to the anvil assembly.

13. The assembly of claim 11, wherein the hydro-percussive mechanism is seated relative to the outer tube such that an application of a percussive from the hammer assembly to the anvil assembly is transmitted to the outer tube.

14. The assembly of claim 1, further comprising a head assembly coupled to the head end of the housing assembly, the head assembly being configured to facilitate positioning of the hydro-percussive mechanism within an outer coring tube.

15. The assembly of claim 14, wherein the head assembly comprises a wireline type head assembly.

16. A wire-line core barrel assembly, comprising:

an outer tube having a lower core barrel;

a hydro-percussive mechanism configured to be positioned within the outer tube and to transmit a percussive force to the lower core barrel, the hydro-percussive mechanism including:

a housing assembly having a head end and a bit end; the housing assembly further including an inlet joint having an inlet channel defined therein, a sealing portion positioned toward the bit end relative to the inlet joint, and a outlet portion positioned toward the bit end relative to the sealing portion;

a hammer assembly having a hammer and a piston, the piston having a piston channel defined therein the piston channel having an inlet in fluid communication with the inlet channel and an outlet in fluid communication with the housing assembly;

an anvil assembly including an anvil; and a biasing member positioned at least partially between the hammer and the anvil, the biasing member biasing the hammer away from the anvil to urge the hammer assembly toward the head end to position the outlet in the piston in communication with the sealing portion of the housing assembly;

wherein the translation of the hammer assembly toward the anvil assembly moves the outlet in the piston into communication with the outlet portion of the housing assembly.

17. The assembly of claim 16, further comprising a wireline head assembly coupled to the hydro-percussive mechanism.

18. The assembly of claim 17, further comprising a swivel joint coupling an overshot assembly to the hydro-percussive mechanism.

19. The assembly of claim 16, further comprising an inner tube positioned within the lower core barrel.

20. The assembly of claim 19, wherein the inner tube is coupled to the anvil assembly.

21. The assembly of claim 19, wherein the hydro-percussive mechanism is seated relative to the outer tube such that an application of a percussive from the hammer assembly to the anvil assembly is transmitted to the outer tube.

22. A drilling system, comprising:

an outer tube having a lower core barrel;

a hydro-percussive mechanism configured to be positioned within the outer tube and to transmit a percussive force to the lower core barrel, the hydro-percussive mechanism including:

a housing assembly having a head end and a bit end; the housing assembly further including inlet channel, a sealing portion positioned toward the bit end relative to the inlet joint, and a outlet portion positioned toward the bit end relative to the sealing portion;

a hammer assembly having a hammer and a piston, the piston having a piston channel defined therein the piston channel having an inlet in fluid communication with the inlet channel and an outlet in fluid communication with the housing assembly; and an anvil assembly including an anvil and an anvil channel extending through the anvil;

wherein translation of the hammer toward the anvil moves the outlet in the piston into communication with the outlet portion of the housing assembly such that fluid can flow from the inlet channel to the anvil channel, and through the anvil to the lower core barrel.

23. The drilling system of claim 22, further comprising a wireline assembly coupled to the hydro-percussive mechanism.

24. A method of drilling, comprising:

positioning an outer tube within a formation, the outer tube including a drill bit secured to a distal end thereof;

inserting a down-the-hole assembly within the outer tube;

latching the down-the-hole assembly to the outer tube;

rotating and driving the drill bit into the formation; and directing pressurized fluid to a piston to generate a pressure force due to engagement between outlets in the piston and sealing portion of a housing assembly of the down-the-hole assembly thereby causing a hammer of the down-the-hole assembly to advance against an anvil of the down-the-hole assembly thereby applying a percussive force to the drill bit;

reducing the pressure force once the hammer is moved toward the anvil by directing pressurized fluid out of the piston through engagement between the outlets in the piston and an outlet portion of the housing assembly, to the anvil, through an anvil channel in the anvil, and beyond the anvil to the drill bit; and moving the hammer assembly to position the outlets in the piston into engagement with the sealing portion of the housing assembly once the pressure force is reduced.

25. The method of claim 24, wherein positioning the down-the-hole assembly within a formation includes submerging the down-the-hole assembly in liquid.

* * * * *